US008425343B1

(12) United States Patent
Olmos

(10) Patent No.: US 8,425,343 B1
(45) Date of Patent: Apr. 23, 2013

(54) GOLF SWING AND GOLF PUTTING STROKE ALIGNMENT AID

(76) Inventor: Oscar Olmos, Shoshone, ID (US)

( * ) Notice: Subject to any disclaimer, the term of this patent is extended or adjusted under 35 U.S.C. 154(b) by 0 days.

(21) Appl. No.: 13/482,250

(22) Filed: May 29, 2012

(51) Int. Cl.
*A63B 69/36* (2006.01)

(52) U.S. Cl.
USPC ..... 473/274; 473/257

(58) Field of Classification Search ..... 473/207, 473/212, 215, 218, 219, 257, 266–277
See application file for complete search history.

(56) References Cited

U.S. PATENT DOCUMENTS

| | | | | | |
|---|---|---|---|---|---|
| 4,513,972 | A * | 4/1985 | Empie | 473/274 |
| 4,659,084 | A * | 4/1987 | Vuick | 473/264 |
| 4,948,142 | A * | 8/1990 | Taber | 473/275 |
| 4,993,716 | A * | 2/1991 | Waller | 473/275 |
| 4,998,731 | A * | 3/1991 | Bowen | 473/271 |
| 5,013,044 | A * | 5/1991 | Hesselbart | 473/218 |
| 5,303,926 | A * | 4/1994 | Owens et al. | 473/261 |
| 5,439,226 | A * | 8/1995 | Luedtke | 473/232 |
| 5,577,729 | A * | 11/1996 | Sabour | 473/274 |
| D387,835 | S * | 12/1997 | Abram et al. | D21/791 |
| 6,896,630 | B1 * | 5/2005 | Breining | 473/422 |
| 7,220,194 | B1 * | 5/2007 | Laiacona, Jr. et al. | 473/454 |
| 7,431,661 | B1 * | 10/2008 | Cailey | 473/257 |
| 2003/0176229 | A1 * | 9/2003 | Jacobys Schutte | 473/257 |

* cited by examiner

*Primary Examiner* — Nini Legesse
(74) *Attorney, Agent, or Firm* — Kyle Fletcher

(57) ABSTRACT

The golf swing and golf putting stroke alignment aid consists of a tripod stand from which a horizontal member attaches and extends outwardly therefrom. A detachable alignment member attaches onto a distal end of the horizontal member, and touches on different surfaces of a golfer to provide an alignment aid for use with a putting stroke or golf swing. The alignment aid is able to give instantaneous feedback to the golfer of proper alignment of a surface of the head, arm, or hand at a particular location along the path of the golf swing or putting stroke. The tripod enables vertical adjustment of the horizontal member, which can rotate thereon in order to provide adjustment of the height and location of the detachable alignment member with respect to the surface of the golfer.

9 Claims, 9 Drawing Sheets

GOLF SWING AND GOLF PUTTING STROKE ALIGNMENT AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of golf, more specifically, an alignment aid that is used in connection with the practice of a putting stroke of a golf swing.

B. Discussion of the Prior Art

As will be discussed immediately below, no prior art discloses an alignment aid that consists of a tripod stand from which a horizontal member is attached and extends outwardly; wherein a distal end of the horizontal member includes a detachable alignment member that is used to engage some surface of the golfer in order to teach a proper putting stroke or golf swing; wherein the detachable alignment member is touched either at a top back of a swing or putting stroke or can be touched after following through on the swing or can be touched at a location on a downswing, or can be touched to limit the putting stroke; wherein the detachable alignment member shall touch either the back surface of a hand, either forearm, or a side of a face when being used to provide an alignment aid for a putting stroke or golf swing.

The Schutte Patent Application Publication (U.S. Pub. No. 2003/0176229) discloses a portable lightweight training aid to guide the golfer during the back swing and downswing, while at the same time allowing the golfer to strike the ball, and which includes a horizontal extending arm that is stabilized via a tripod. However, the golf swing guide includes the use of a rigid elongated member that requires the end user to follow his/her swing along said member, and not a detachable alignment member that touches the actual golfer at a single location during a golf swing or putting stroke.

The Bowen Patent (U.S. Pat. No. 4,998,731) discloses a golf practice device for putting and swinging a golf club. However, the golf practice device is limited to engaging the face or head of the golfer, and does not provide a means of alignment to other surfaces of the golfer for use at a specific location during a golf swing or putting stroke.

The Sabour Patent (U.S. Pat. No. 5,577,729) discloses a golf swing training apparatus that reveals head movement of a golfer. However, the apparatus does not provide for adjustment of the head movement detector vertically-speaking. Moreover, the head movement detector only detects movement of the head and does not provide a means of alignment for interaction with other surfaces of the golfer at various times along a swing or putting stroke.

The Vuick Patent (U.S. Pat. No. 4,659,084) discloses a golf swing training apparatus. Again, the apparatus engages a surface of the face or head, and is not adjustable in height or location to interact with a different surface of the golfer for use as an alignment aid during different aspects of a golf swing or putting stroke.

The Breining Patent (U.S. Pat. No. 6,896,630) discloses a tripod motion training device for a user's body to travel along. However, the targets engage different positions along a path of travel, and do not simply provide a detachable alignment member that is adjusted to touch any of a plurality of surfaces of golfer to provide alignment means at a particular location along a golf swing or putting stroke.

The Luedtke Patent (U.S. Pat. No. 5,439,226) discloses a training apparatus for golfers that assists the golfer to hold the golfer's head steady during his swing. Again, the apparatus only touches a surface of the head, and is not adaptive for use in touching different surfaces of the arms and hands to aid in alignment at different locations on a putting stroke or golf swing.

The Empie Patent (U.S. Pat. No. 4,513,972) discloses a golfer's head movement restraining device. Again, the device engages and restrains the head, and does not touch against other surfaces of the golfer to teach alignment during a particular location of a golf swing or putting stroke.

The Hesselbart Patent (U.S. Pat. No. 5,013,044) discloses a method and apparatus for developing a proper golf stance, swing plane, and an alignment in golfers. However, the method and apparatus do not provide an alignment aid that touches a surface of the head, arm, or hand of the golfer at a particular location along a golf swing or putting stroke.

The Taber Patent (U.S. Pat. No. 4,948,142) discloses an apparatus for assisting a golfer to develop a proper position and swing for his golf club. Again, the apparatus engages multiple surfaces of a golfer simultaneously, and is not adaptive to provide alignment at a particular location along a putting stroke or golf swing.

While the above-described devices fulfill their respective and particular objects and requirements, they do not describe an alignment aid that consists of a tripod stand from which a horizontal member is attached and extends outwardly; wherein a distal end of the horizontal member includes a detachable alignment member that is used to engage some surface of the golfer in order to teach a proper putting stroke or golf swing; wherein the detachable alignment member is touched either at a top back of a swing or putting stroke or can be touched after following through on the swing or can be touched at a location on a downswing, or can be touched to limit the putting stroke; wherein the detachable alignment member shall touch either the back surface of a hand, either forearm, or a side of a face when being used to provide an alignment aid for a putting stroke or golf swing. In this regard, the golf swing and golf putting stroke alignment aid device departs from the conventional concepts and designs of the prior art.

SUMMARY OF THE INVENTION

The golf swing and golf putting stroke alignment aid consists of a tripod stand from which a horizontal member attaches and extends outwardly therefrom. A detachable alignment member attaches onto a distal end of the horizontal member, and touches on different surfaces of a golfer to provide an alignment aid for use with a putting stroke or golf swing. The alignment aid is able to give instantaneous feedback to the golfer of proper alignment of a surface of the head, arm, or hand at a particular location along the path of the golf swing or putting stroke. The tripod enables vertical adjustment of the horizontal member, which can rotate thereon in order to provide adjustment of the height and location of the detachable alignment member with respect to the surface of the golfer.

It is an object of the invention to provide an alignment aid that can adjust elevationally speaking or around a stand, and which is used to provide a means of alignment at a single location upon a surface of the golfer's arm or arms, hand or hands, or surface of the face to indicate proper putting stroke or golf swing.

A further object of the invention is to provide a detachable alignment member that attaches onto the distal end of the horizontal member and either of which is responsible for engaging the surface of the golfer in connection with a golf swing or putting stroke.

A further object of the invention is to provide a detachable alignment member and/or horizontal member that engages the arms, back of a hand, or a surface of the head to offer alignment assistance to the golfer practicing his/her putting stroke or golf swing.

These together with additional objects, features and advantages of the golf swing and golf putting stroke alignment aid will be readily apparent to those of ordinary skill in the art upon reading the following detailed description of presently preferred, but nonetheless illustrative, embodiments of the golf swing and golf putting stroke alignment aid when taken in conjunction with the accompanying drawings.

In this respect, before explaining the current embodiments of the golf swing and golf putting stroke alignment aid in detail, it is to be understood that the golf swing and golf putting stroke alignment aid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf swing and golf putting stroke alignment aid.

It is therefore important that the claims be regarded as including such equivalent construction insofar as they do not depart from the spirit and scope of the golf swing and golf putting stroke alignment aid. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
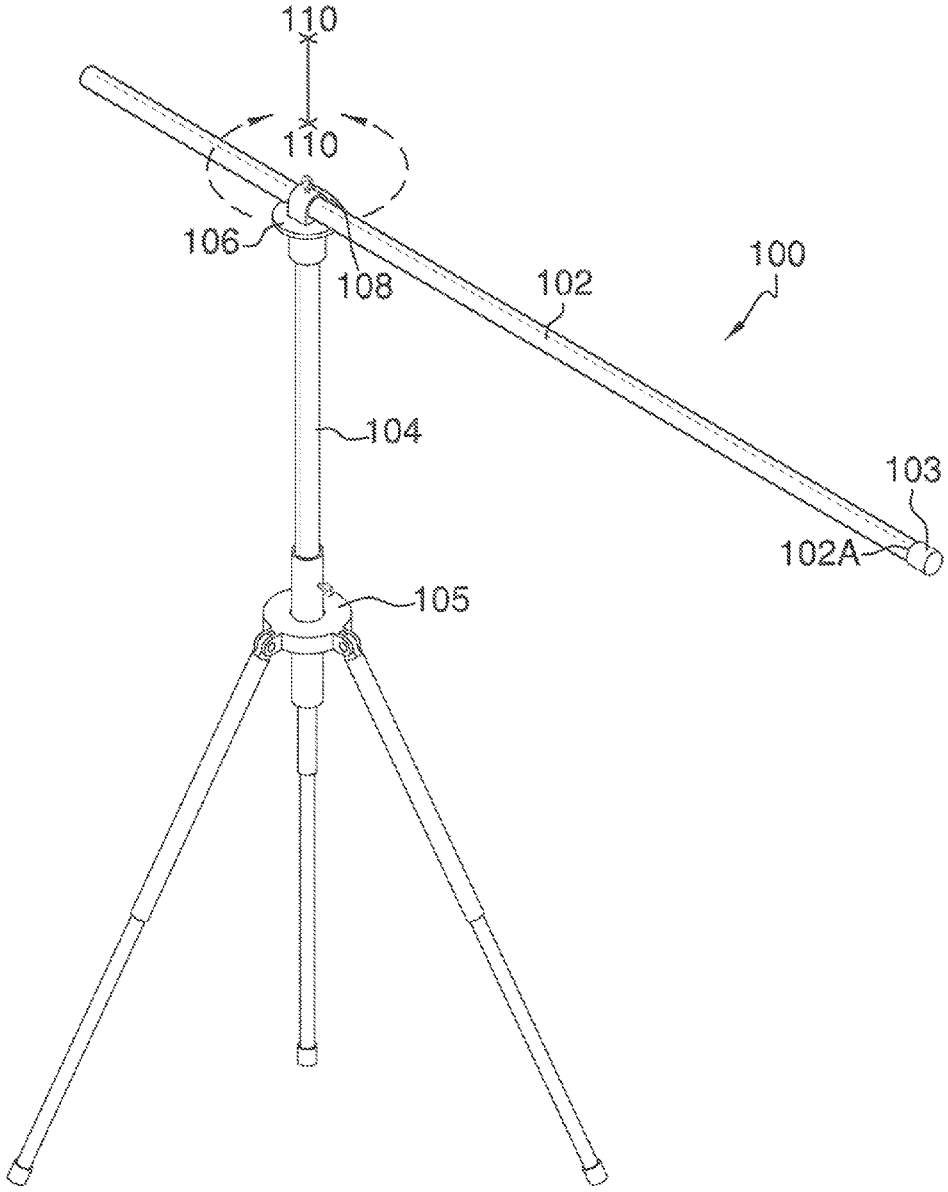
FIG. 1 illustrates a perspective view of the alignment aid by itself.
Figure 2:
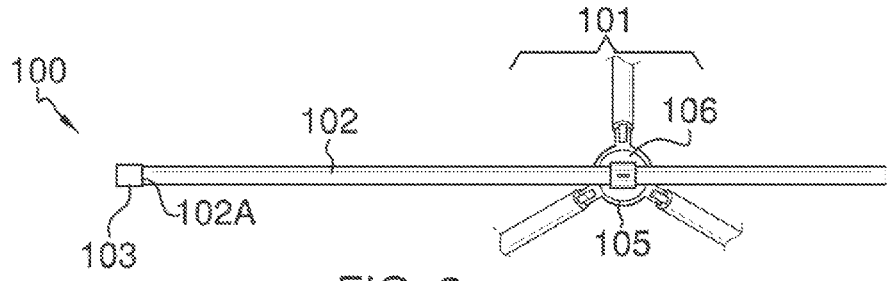
FIG. 2 illustrates a top view of the alignment aid by itself.
Figure 3:
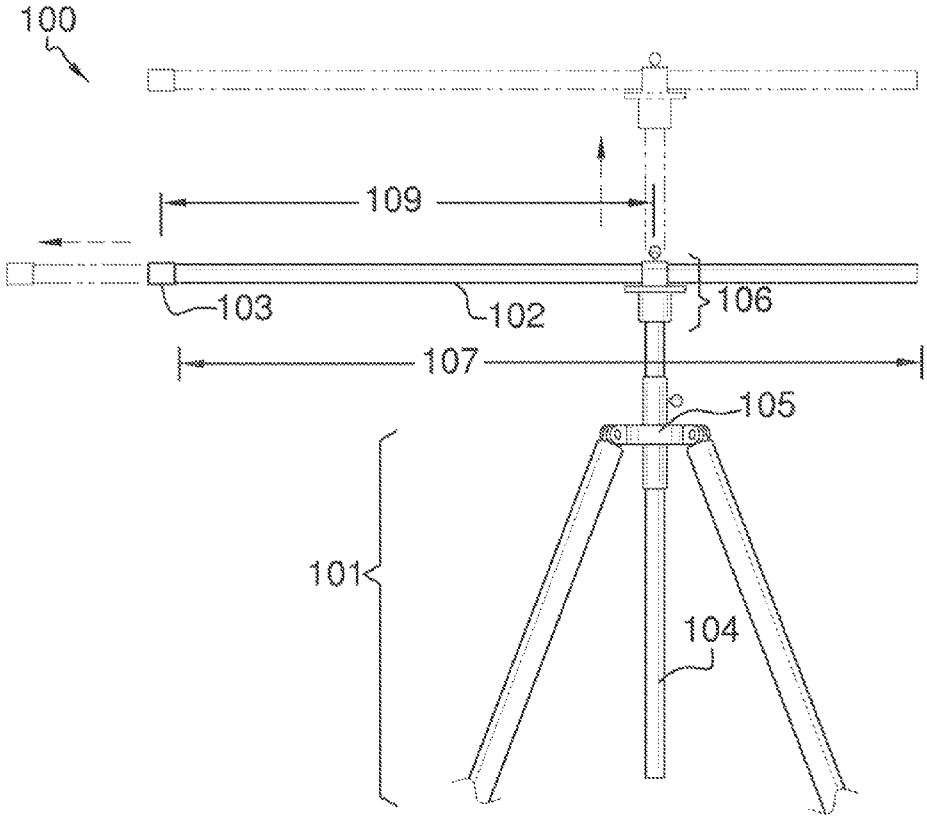
FIG. 3 illustrates a side view of the alignment aid wherein arrows indicated vertical adjustment or extension of the horizontal member with respect to the tripod.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6B. A golf swing and golf putting stroke alignment aid 100 (hereinafter invention) includes a tripod 101, a horizontal member 102, and a detachable alignment aid 103.

The tripod 101 can fold up when not in use, but otherwise sits on a ground surface 150, and is vertically adjustable. The tripod 101 includes a vertical member 104 that attaches to a central mount 105. The vertical member 104 can extend up or down, and includes a bracket 106 at a distal end, which is used to secure the horizontal member 102 thereon. The horizontal member 102 is of an undefined length 107, and is an elongated bar, which attaches to the bracket 106, and is secured in place via a thumbscrew 108. The horizontal member 102 can extend away from the tripod 101 by a horizontal distance 109. The horizontal distance 109 is adjustable. Also, the horizontal member 102 and the bracket 106 can rotate around a vertical axis 110 with respect to the tripod 101 (see FIG. 1). Moreover, the horizontal member 102 and the bracket 106 can rotate to different angles 111 (see FIG. 6A) with respect to the ground surface 150 such that the horizontal member 102 is highly adjustable for different configurations of use. That being said, the angle 111 renders the horizontal member 102 in an unparallel orientation with respect to the ground surface 150.

The horizontal member 102 is further defined with a distal end 102A that extends farthest from the tripod 101, and upon which the detachable alignment aid 103 affixes. Both the horizontal member 102 and the detachable alignment aid 103 are used to provide alignment means in connection with practicing a putting stroke (see FIGS. 4A-4C) or a golf swing (see FIGS. 5A-5B and 6A-6B).

Figure 4A:
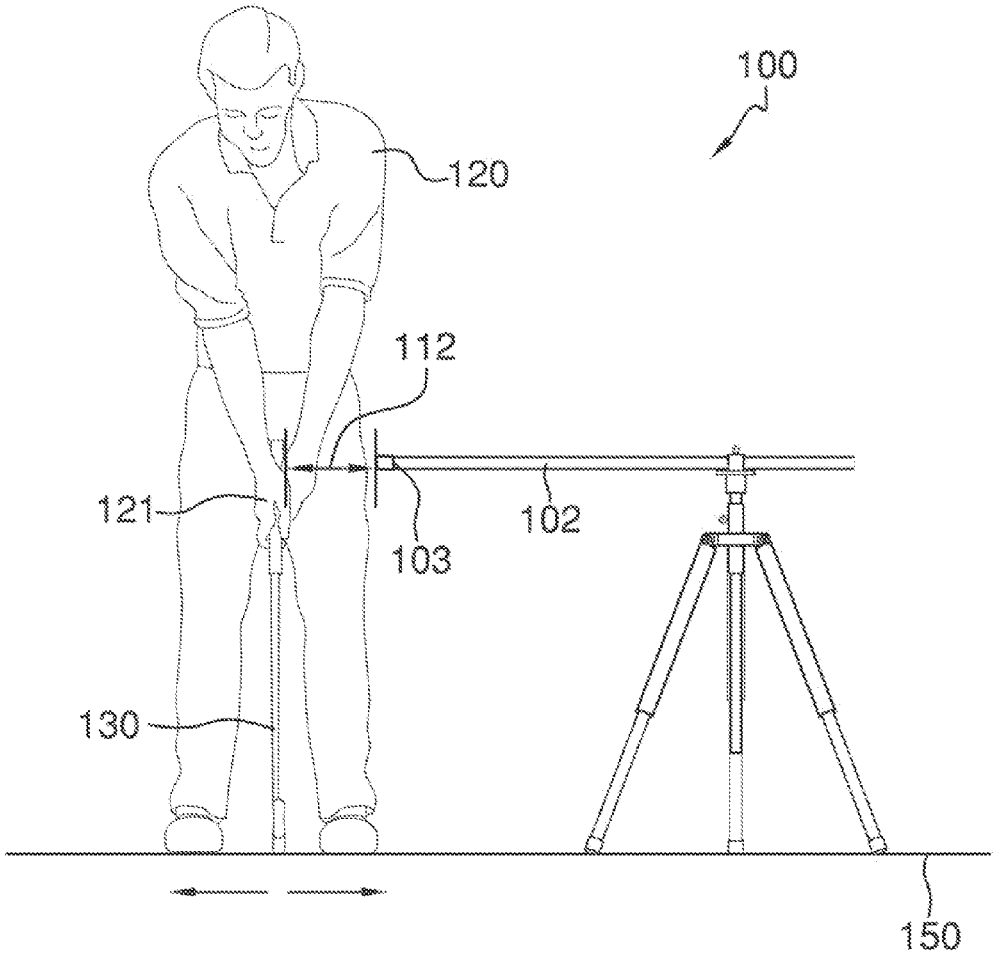
FIG. 4A illustrates a view of the alignment aid in use with a golfer who is in stance for a putting stroke, and detailing the location of the detachable alignment aid at a distance with respect to the hands of the golfer.
Figure 4B:
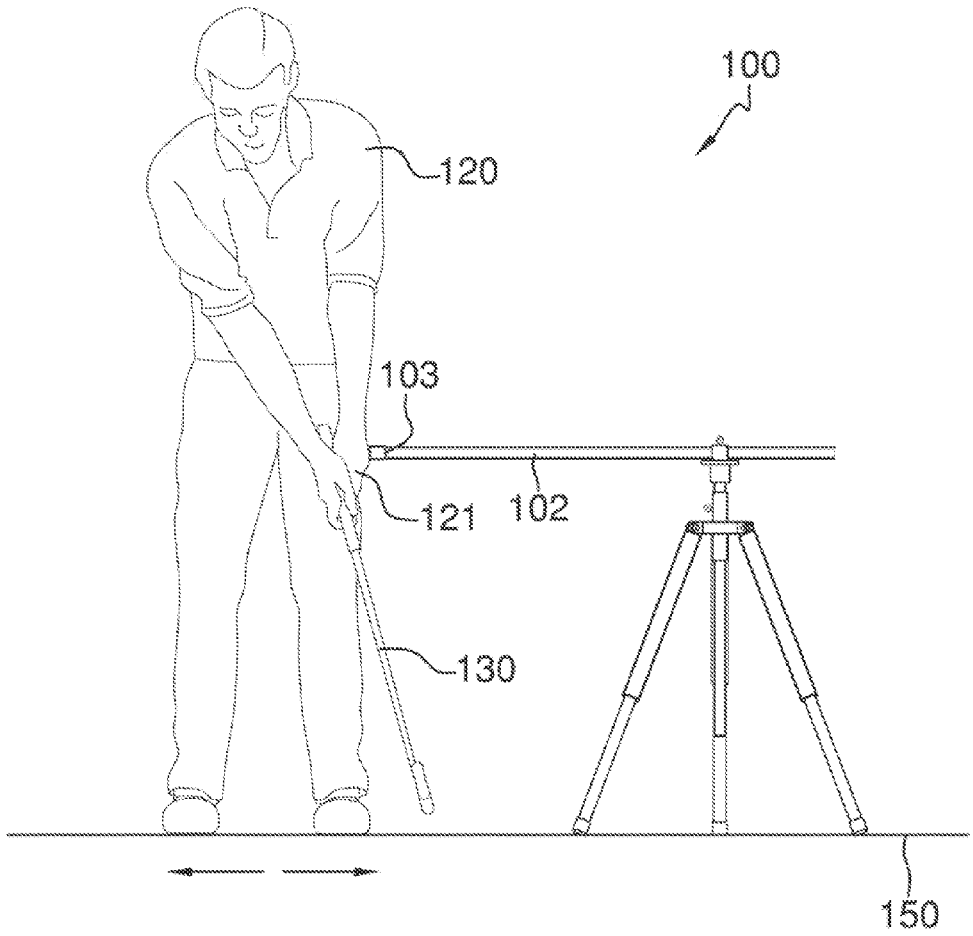
FIG. 4B illustrates a view of the alignment aid in use wherein the golfer has performed the putting stroke at which point the detachable alignment aid is touched by the golfer's hand to indicate the end of the path of the putting stroke.
Figure 4C:
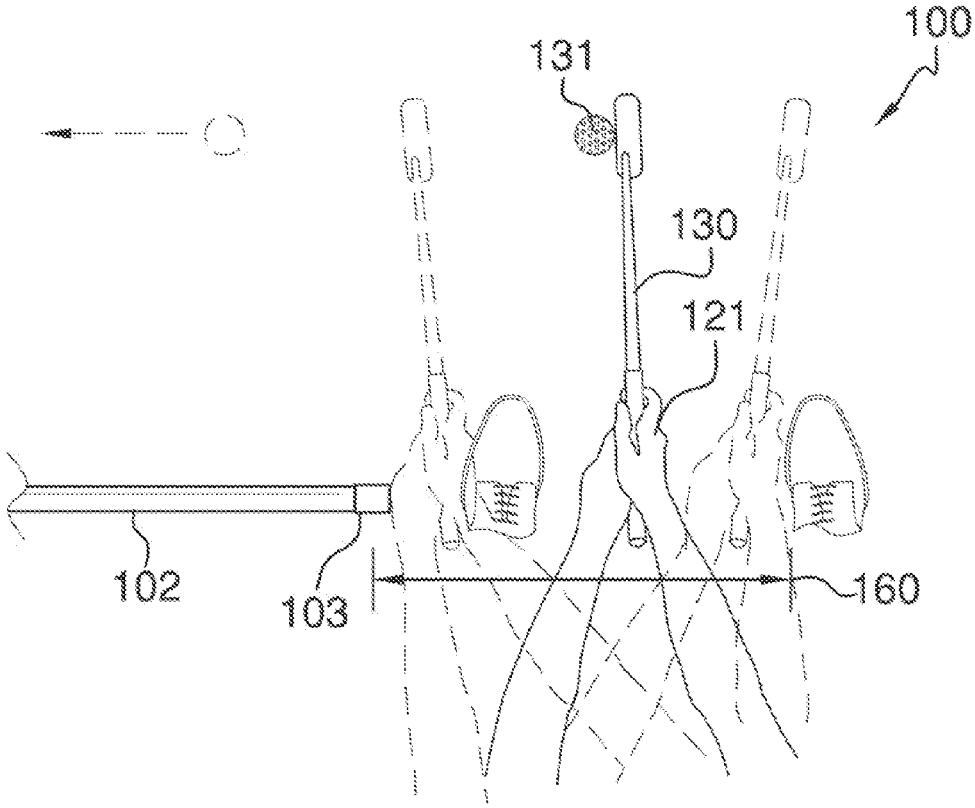
FIG. 4C illustrates an overhead view from the position of the golfer, and further details the use of the detachable alignment aid as a stop to indicate where to end the putting stroke.

Referring to FIGS. 4A-4C, the invention 100 can be adapted for use as an alignment means that helps to practice a proper putting stroke. A golfer 120 holding a putter 130 shall make a proper putting stance (see FIGS. 4A and 4C), and align the detachable alignment aid 103 and the horizontal member 102 along a path of travel 160. Moreover, the path of travel 160 is with respect to movement of hands 121 of the golfer 120 back and forth. That being said, as the golfer 120 moves the putter 130 and hits a golf ball 131, the hands 121 touch against the detachable alignment aid 103 (see FIG. 4C), and which indicates to the golfer 120 where and when to stop the path of travel 160. An alignment distance 112 shall be the distance formed between the detachable alignment aid 103 and the hands 121 of the golfer 120 prior to commencement of the path of travel 160.

Figure 5A:
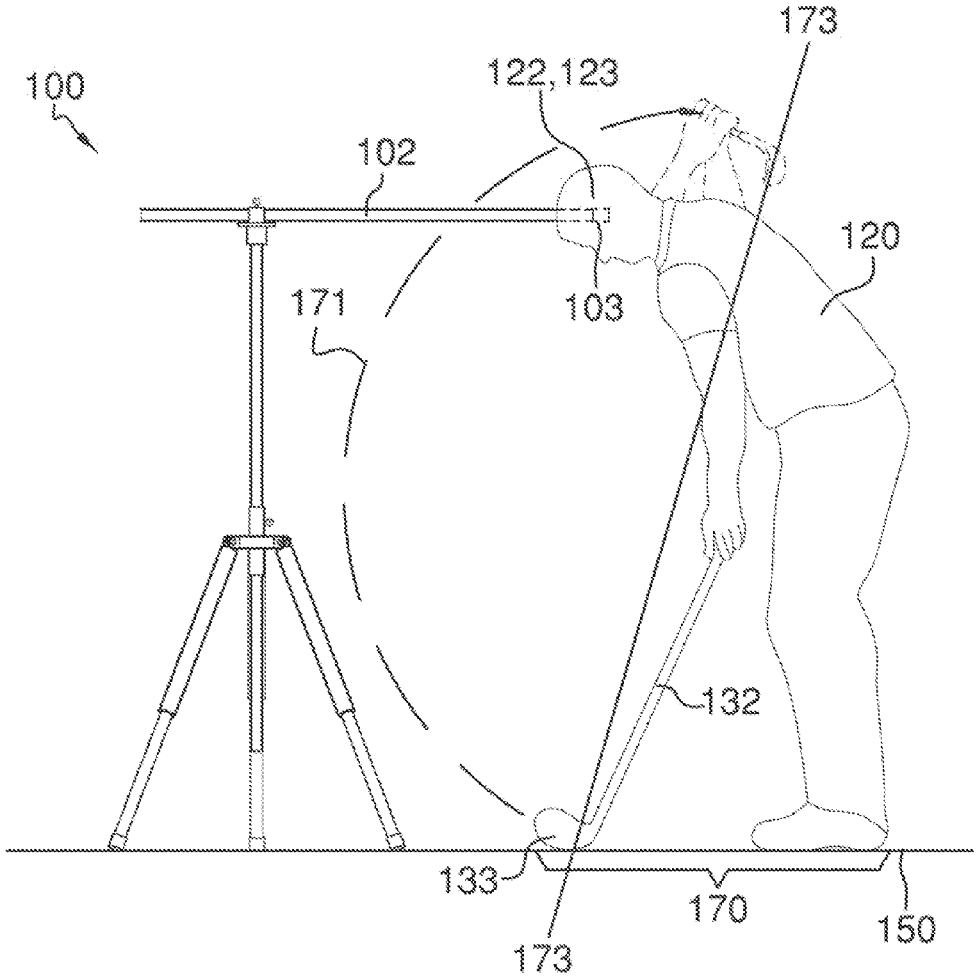
FIG. 5A illustrates a view of the alignment aid in use with a golfer who is in stance for a golf swing and with the detachable alignment aid engaging a surface of the head of the golfer to teach proper head positioning prior to and during a portion of the golf swing.
Figure 5B:
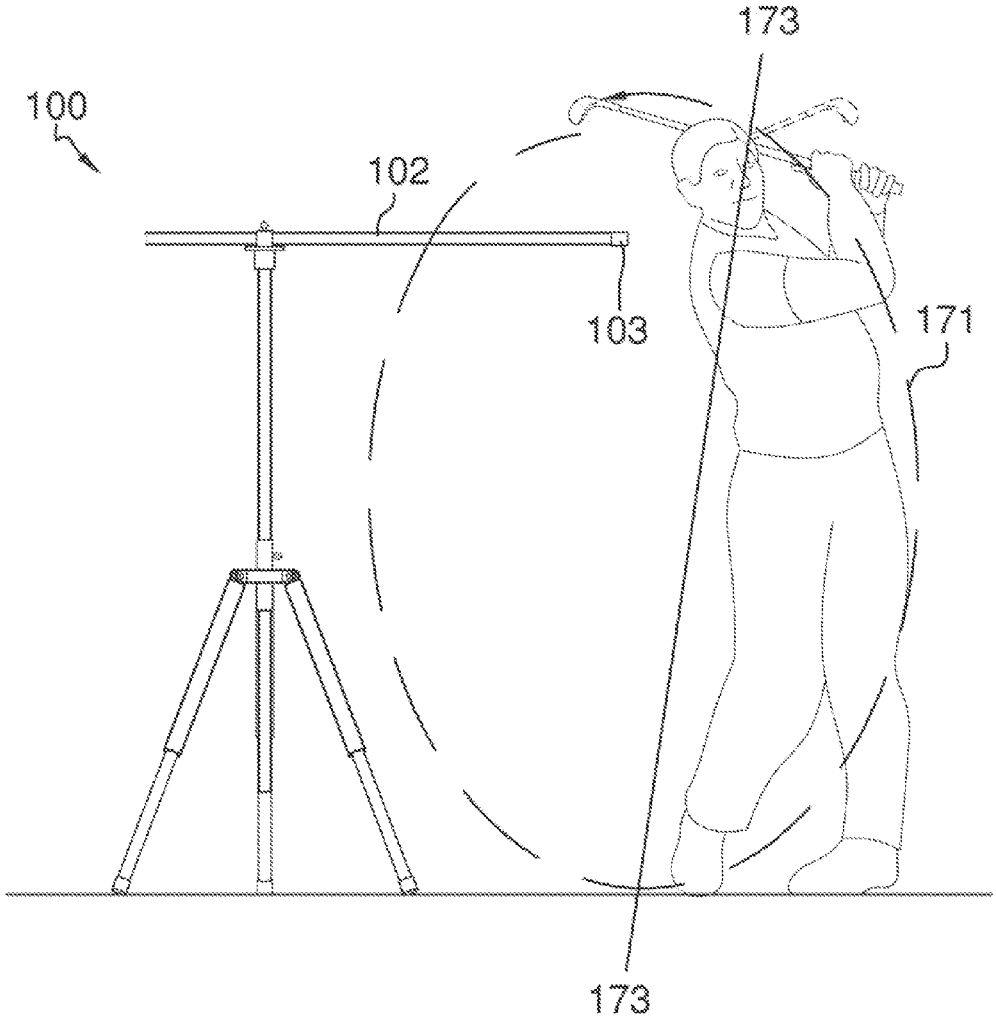
FIG. 5B illustrates a view of the alignment aid in use wherein the golfer has performed the golf swing.

Referring to FIGS. 5A-5B, the invention 100 can be adapted for use in teaching proper head placement during a golf swing. In such an instance, the horizontal member 102 and the detachable alignment aid 103 are raised upwardly with respect to the vertical axis 110, and the detachable alignment aid 103 is positioned to touch a surface of a face 122 or head 123 of the golfer 120. It shall be noted that the detachable alignment aid 103 is to be used to indicate proper alignment of the head 123 when forming a golf stance 170. The golf stance 170 is being defined as the stance formed prior to and during a portion of a golf swing. As the golfer 120 begins rotation of a golf club 132 along a backswing 171 (see FIG. 5A), the head 123 of the golfer 120 shall remain stationary. Keeping your head straight during the backswing 171 and portion of a follow through 172 is well known in the art, and is the bane of the golfer 120 who forgets to keep his or her head down when striking the golf ball 131.

A swing plane 173 is defined as the plane of movement of a golf club head 133 through the backswing 171 and the follow through 172. That being said, the golfer 120 shall keep the detachable alignment aid 103 touching the face 122 or the head 123, through the entire backswing 171, and through a portion of the follow through 172, and until striking the golf ball 131.

Figure 6A:
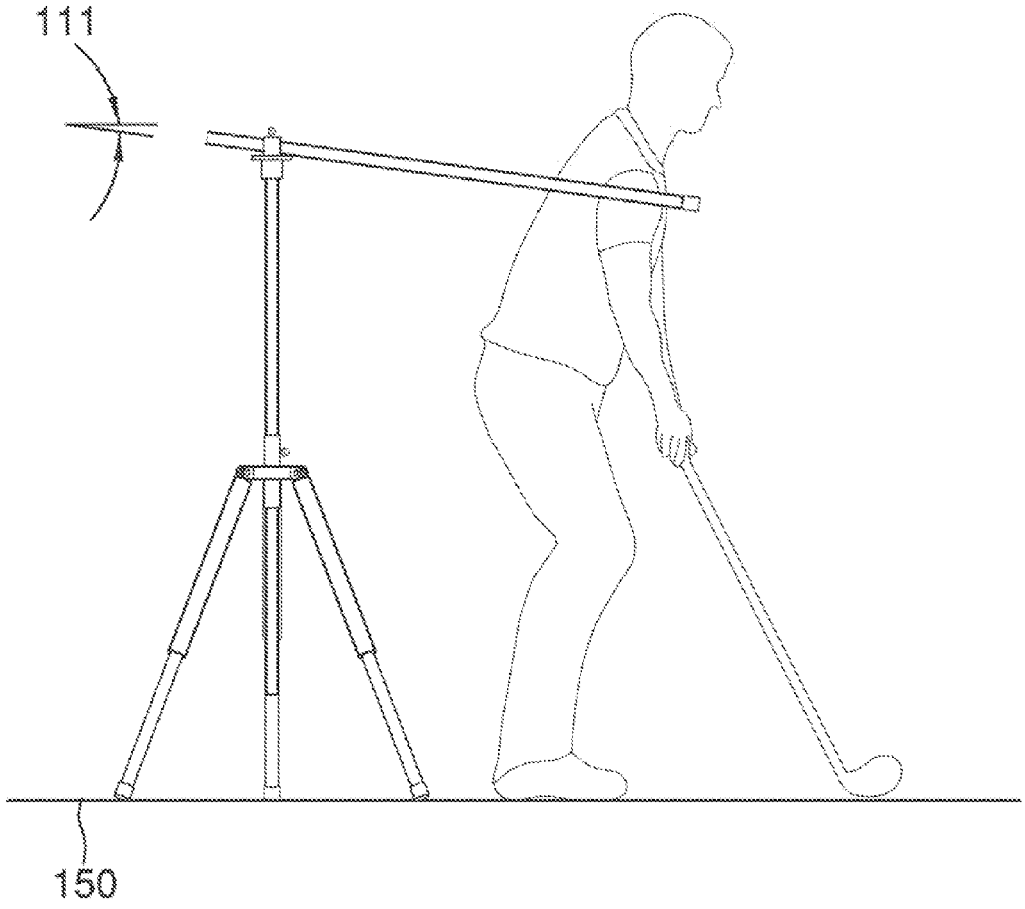
FIG. 6A illustrates a view of the alignment aid in use with a golfer who is in stance for a golf swing and with the horizontal member at an angle with the ground surface.
Figure 6B:
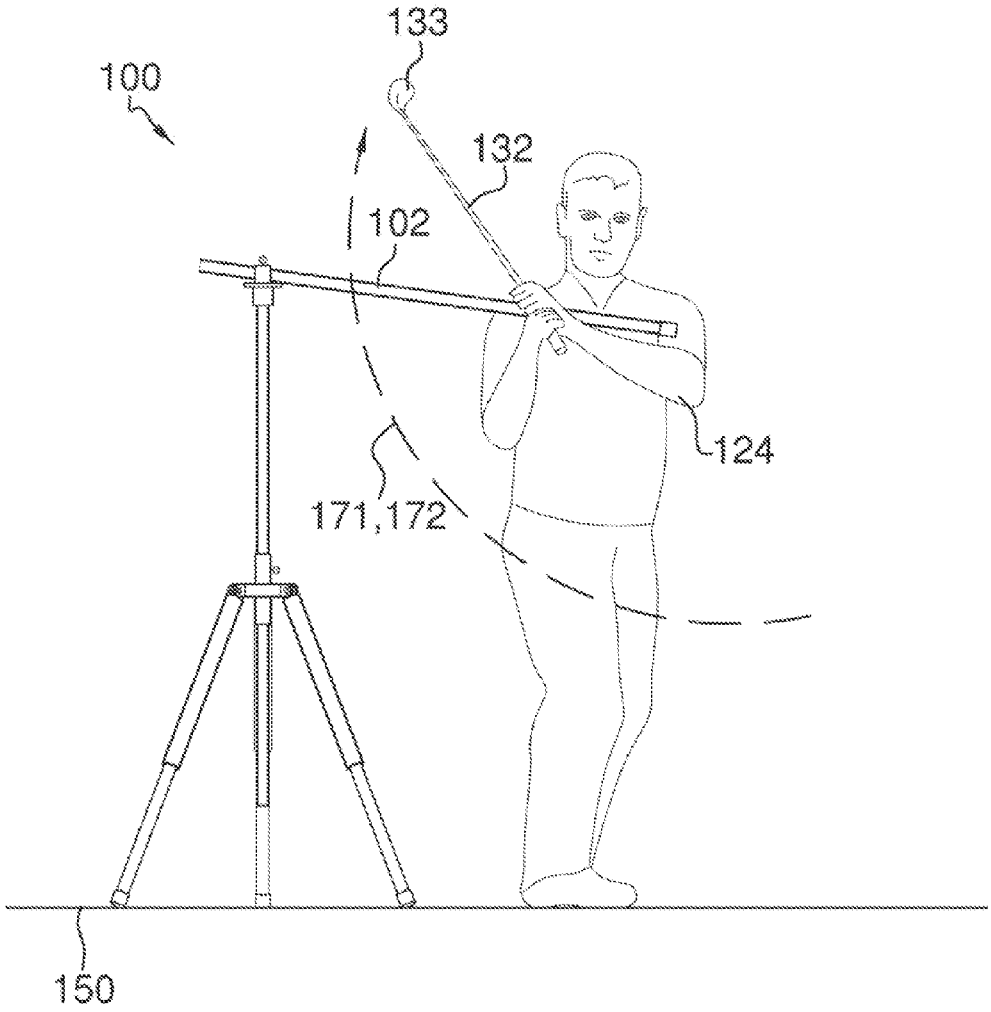
FIG. 6B illustrates a view of the alignment aid in use with a golfer who has performed a golf swing at a point during the path of travel wherein the forearms touch against the horizontal member, and which teaches proper arm placement at said point along the path of travel of the golf swing.

Referring to FIGS. 6A-6B, the invention 100 can be adapted for use as an alignment aid during a particular location along the swing plane 173. As a side note, it shall be noted that the path of travel 160 and the swing plane 173 being depicted in FIGS. 4A-6B, can be adapted for either a right-handed or a left-handed golfer. The detachable alignment aid 103 and the horizontal member 102 may be adjusted to form the angle 111 mentioned earlier. More the point, either the detachable alignment aid 103 or the horizontal member 102 may be touched by either or both arms 124 during either the backswing 171 or the follow through 172.

Referring to FIG. 6B, the horizontal member 102 touches the arms 124 of the golfer 120 either during the backswing 171 or the follow through 172. It is important to note that the horizontal member 102 can touch either or both arms 124 of the golfer 120, and that the point of touch the horizontal member 102 with the arm(s) 124 may be at an end of or during the backswing 171 or follow through 172. The ability to adjust the angle 11 is important in that the golfer 120 may need to work on the backswing 171 at a highest point of the backswing 171 or at a point along the backswing 171. Also, the golfer 120 may need to work on the follow through 172 at a point along the follow through 172 or at a highest point of the follow through 172.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A golf swing and golf putting stroke alignment aid comprising:

a tripod, a horizontal member, and a detachable alignment aid;

wherein the horizontal member attaches to the tripod, and can rotate around, extend up or down with respect to a ground surface, or form an angle with respect to the tripod;

wherein the vertical member attaches to a central mount located on the tripod; wherein the vertical member can extend up or down, and includes a bracket at a distal end, which is used to secure the horizontal member thereon;

wherein a golfer touches a hand, arm(s), or head, or face against the detachable alignment aid in connection with a practice of a putting stroke or golf swing in order to teach proper alignment therein;

wherein the horizontal member is of an undefined length, and attaches to and secures about the bracket via a thumbscrew;

wherein the horizontal member can extend away from the tripod by a horizontal distance, which is adjustable;

wherein the horizontal member is further defined with a distal end that extends farthest from the tripod, and upon which the detachable alignment aid affixes.

2. The golf swing and golf putting stroke alignment aid as described in claim 1 wherein the detachable alignment aid and the horizontal member are positioned along a path of travel of a golf putting stroke such that the detachable alignment aid is touched by a hand of the golfer at an end of the path of travel in order to teach a proper putting stroke; wherein the detachable alignment aid is positioned at an alignment distance away from said hand prior to commencement of said golf putting stroke.

3. The golf swing and golf putting stroke alignment aid as described in claim 2 wherein the detachable alignment aid and the horizontal member are positioned adjacent said golfer who is in a golf stance; wherein the detachable alignment aid touches a head or face of the golfer in order to teach proper head placement during a backswing and a portion of a follow through associated with said golf swing; wherein the tripod, horizontal member, and detachable alignment aid do not interfere with a swing plane and movement of the golfer during said golf swing.

4. The golf swing and golf putting stroke alignment aid as described in claim 2 wherein the horizontal member and/or the detachable alignment are positioned relative to a golf stance such that either or both arms of said golfer touch either or both the horizontal member and/or detachable alignment aid at a particular location along either the backswing or follow through associated with said golf swing.

5. A golf swing and golf putting stroke alignment aid comprising:

a tripod, a horizontal member, and a detachable alignment aid;

wherein the horizontal member attaches to the tripod, and can rotate around, extend up or down with respect to a ground surface, or form an angle with respect to the tripod;

wherein a golfer touches a hand, arm(s), or head, or face against the detachable alignment aid in connection with a practice of a putting stroke or golf swing in order to teach proper alignment therein;

wherein the horizontal member is further defined with a distal end that extends farthest from the tripod, and upon which the detachable alignment aid affixes;

wherein the vertical member attaches to a central mount located on the tripod; wherein the vertical member can extend up or down, and includes a bracket at a distal end, which is used to secure the horizontal member thereon;

wherein the horizontal member is of an undefined length, and attaches to and secures about the bracket via a thumbscrew;

wherein the horizontal member can extend away from the tripod by a horizontal distance, which is adjustable;

wherein the detachable alignment aid and the horizontal member are positioned along a path of travel of a golf putting stroke such that the detachable alignment aid is touched by a hand of the golfer at an end of the path of travel in order to teach a proper putting stroke; wherein the detachable alignment aid is positioned at an alignment distance away from said hand prior to commencement of said golf putting stroke.

6. The golf swing and golf putting stroke alignment aid as described in claim 5 wherein the detachable alignment aid and the horizontal member are positioned adjacent said golfer who is in a golf stance; wherein the detachable alignment aid touches a head or face of the golfer in order to teach proper head placement during a backswing and a portion of a follow through associated with said golf swing; wherein the tripod, horizontal member, and detachable alignment aid do not interfere with a swing plane and movement of the golfer during said golf swing.

7. The golf swing and golf putting stroke alignment aid as described in claim 6 wherein the horizontal member and/or the detachable alignment are positioned relative to a golf stance such that either or both arms of said golfer touch either or both the horizontal member and/or detachable alignment aid at a particular location along either the backswing or follow through associated with said golf swing.

8. A golf swing and golf putting stroke alignment aid comprising:

a tripod, a horizontal member, and a detachable alignment aid;

wherein the horizontal member attaches to the tripod, and can rotate around, extend up or down with respect to a ground surface, or form an angle with respect to the tripod;

wherein a golfer touches a hand, arm(s), or head, or face against the detachable alignment aid in connection with a practice of a putting stroke or golf swing in order to teach proper alignment therein;

wherein the horizontal member is further defined with a distal end that extends farthest from the tripod, and upon which the detachable alignment aid affixes;

wherein the vertical member attaches to a central mount located on the tripod; wherein the vertical member can extend up or down, and includes a bracket at a distal end, which is used to secure the horizontal member thereon;

wherein the horizontal member is of an undefined length, and attaches to and secures about the bracket via a thumbscrew;

wherein the horizontal member can extend away from the tripod by a horizontal distance, which is adjustable;

wherein the detachable alignment aid and the horizontal member are positioned along a path of travel of a golf putting stroke such that the detachable alignment aid is touched by a hand of the golfer at an end of the path of travel in order to teach a proper putting stroke; wherein the detachable alignment aid is positioned at an alignment distance away from said hand prior to commencement of said golf putting stroke;

wherein the detachable alignment aid and the horizontal member are positioned adjacent said golfer who is in a golf stance;

wherein the detachable alignment aid touches a head or face of the golfer in order to teach proper head placement during a backswing and a portion of a follow through associated with said golf swing;

wherein the tripod, horizontal member, and detachable alignment aid do not interfere with a swing plane and movement of the golfer during said golf swing.

9. The golf swing and golf putting stroke alignment aid as described in claim 8 wherein the horizontal member and/or the detachable alignment are positioned relative to a golf stance such that either or both arms of said golfer touch either or both the horizontal member and/or detachable alignment aid at a particular location along either the backswing or follow through associated with said golf swing.

* * * * *